United States Patent [19]

DeLau

[11] 4,407,356

[45] Oct. 4, 1983

[54] PORTABLE QUICK CHILLING AND HEATING APPLIANCE

[76] Inventor: Bruce E. DeLau, 7111 Marshall Ave., Hammond, Ind. 46323

[21] Appl. No.: 241,677

[22] Filed: Mar. 9, 1981

[51] Int. Cl.[3] ..... F28D 7/02

[52] U.S. Cl. ..... 165/132; 62/399; 62/400; 126/261; 165/80 E; 165/163; 165/169; 222/146 C

[58] Field of Search ..... 165/80 E, 80 R, 163, 165/132, 169–170; 62/398, 399, 400; 126/261; 222/146 C

[56] References Cited

U.S. PATENT DOCUMENTS

| | | | |
|---|---|---|---|
| 172,687 | 1/1876 | Baeppler | 165/132 |
| 869,745 | 10/1907 | Spencer | 62/400 |
| 986,276 | 3/1911 | Freeman | 165/163 |
| 1,078,214 | 11/1913 | Patnaude | 62/400 |

FOREIGN PATENT DOCUMENTS

| | | | |
|---|---|---|---|
| 747786 | 6/1933 | France | 62/400 |
| 340842 | 5/1936 | Italy | 62/400 |

*Primary Examiner*—Sheldon J. Richter

*Attorney, Agent, or Firm*—Leydig, Voit, Osann, Mayer & Holt, Ltd.

[57] ABSTRACT

A portable appliance for quick chilling and heating of fluids, such as beverages, without dilution. The appliance comprises a pour-through, gravity operated heat exchanger, an intake reservoir connected to its upper end, and a discharge tap connected to its lower end. It operates without application of electric or mechanical power, and may be used both indoors or in the field.

1 Claim, 5 Drawing Figures

PORTABLE QUICK CHILLING AND HEATING APPLIANCE

DESCRIPTION OF THE INVENTION

The present invention relates to the field of appliances for chilling and heating of fluids. It finds particular, but not exclusive, utility in the quick chilling of small quantities of various beverages such as beer, wine, and soft drinks, and also in the quick heating of clear fluid foods. Both heating and cooling are accomplished without diluting the fluid handled by the appliance.

In this country and in many others, beverages such as beer, wine and soft drinks are commonly sold in jugs, bottles, or cans usually at room temperature. Before they are consumed, it is customary to chill them in a refrigerator or in a cooler chest. In many instances, particularly when traveling out of doors, a refrigerator is not available. Moreover, ordinary cooler chests are bulky and burdensome to carry. However, ice in various forms, particularly cubes or chunks, is widely available by the bag even in somewhat remote locations.

With the foregoing in mind, the general aim of the present invention is to provide a portable appliance for quick chilling of fluids such as beverages which operates without dilution, and which requires no external power source.

A more specific object of the invention is to provide a portable appliance of the character set forth above utilizing a pour-through gravity operated heat exchanger capable of chilling several ounces of beer or wine within a two to three minute interval.

A further object is to provide a portable appliance of the foregoing character which is also well adapted for quick heating of fluid foods and beverages such as clear soup or hot chocolate.

Another object of the invention is to provide a portable appliance of the type set forth above which will be of simple, economical construction yet sufficiently rugged to withstand use both indoors or in the field.

Other objects and advantages will become apparent as the following description proceeds, taken in connection with the accompanying drawings, wherein.

Figure 1:
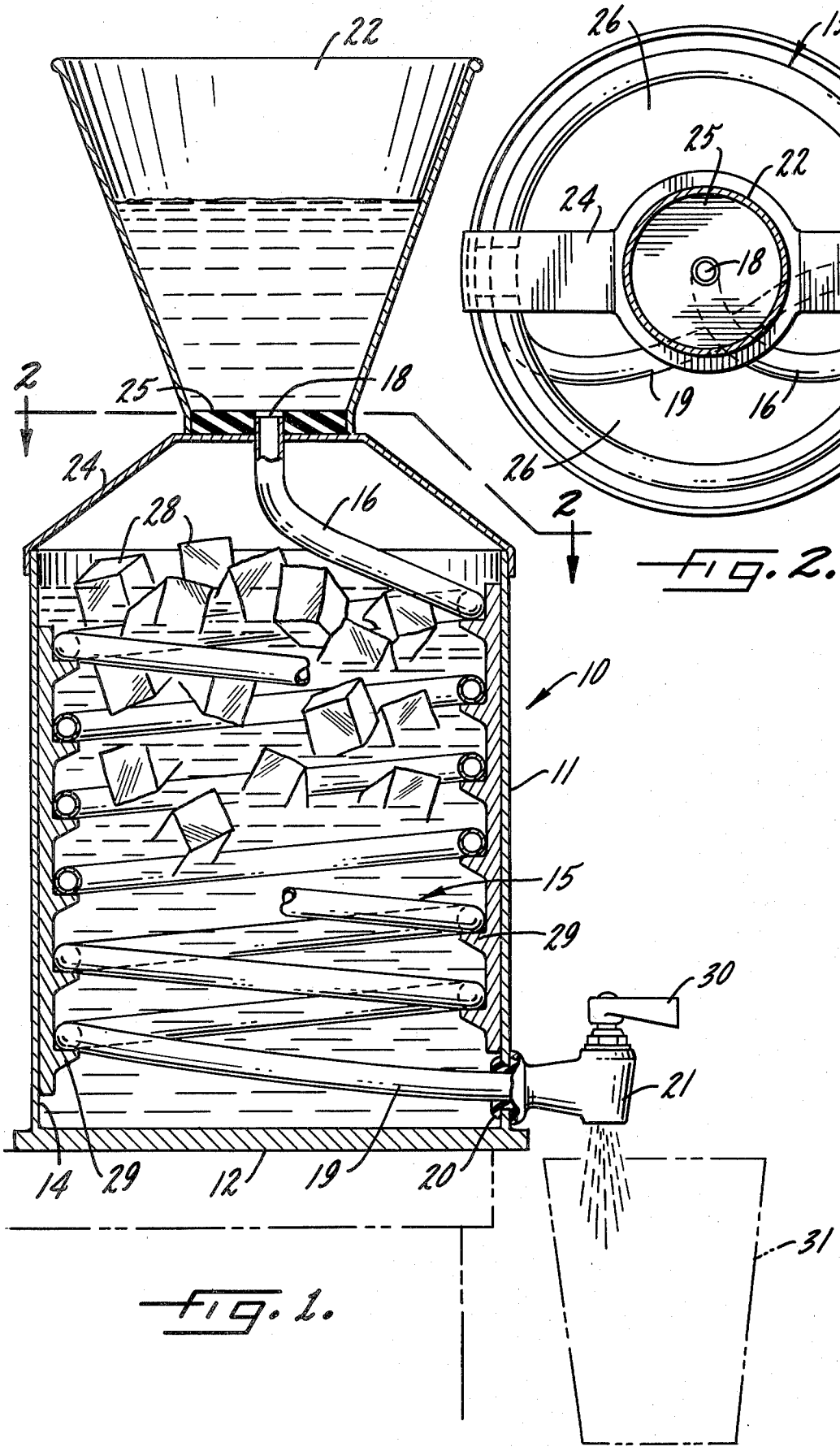
FIG. 1 is a vertical sectional view of an illustrative chilling and heating appliance embodying the present invention, with the device shown in operating condition.
Figure 2:
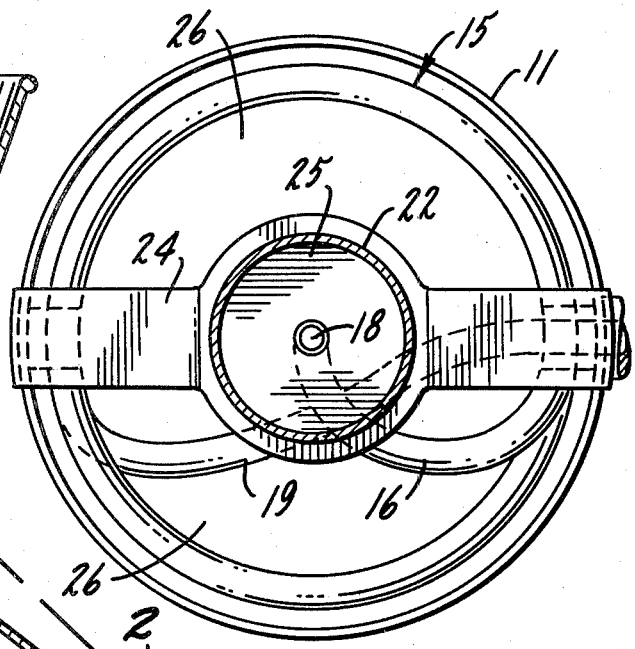
FIG. 2 is a horizontal sectional view of the appliance illustrated in FIG. 1, taken in the plane of the line 2—2 in FIG. 1.

While the invention is susceptible of various modifications and alternative constructions, certain illustrative embodiments have been shown in the drawings and will be described below in considerable detail. It should be understood, however, that there is no intention to limit the invention to the specific form described but, on the contrary, the intention is to cover all modifications, alternative constructions and equivalents falling within the scope of the appended claims.

Referring more specifically to FIG. 1, the invention is there exemplified in an illustrative chilling and heating appliance 10. The latter comprises a container 11 which in the present instance happens to be of generally cylindrical form. The container 11 is fluid tight and formed with a substantial bottom 12 adapted to rest upon a relatively flat support. The container is closed at the bottom but open at the top and has a generally cylindrical inner peripheral wall.

Housed within the container 11 and disposed in spaced relation with the inner peripheral wall 14 is a pour-through, gravity operated heat exchanger. The latter is formed in this case as a generally helical coil 15 of metal tubing which may, for example, be of aluminum or stainless steel. The coil is disposed within the container so that its helical axis coincides approximately with the vertical axis of the container 11. The upper end portion 16 of the coil is directed radially inward and upward toward the axis of the container and terminates in an intake 18. The lower end portion 19 of the coil extends radially outward and passes through the lower portion of the container wall in fluid tight relation therewith. The lower end portion 19 is connected to the container wall by fluid tight seal 20 and terminates at an outlet tap 21. The coil 15 is formed so that its convolutions define a continuous downward slope from the intake 18 to the outlet 21.

For introducing fluid to the intake appliance 19, a reservoir 22 is mounted above the container. The reservoir in this instance may be of frustoconical form and is mounted on a support structure in the form of bridge 24. The bridge 24 also supports the intake 18 and a fluid tight seal 25 between the intake 18 and the reservoir 22. The bridge is constructed and arranged to leave relatively large loading apertures 26 on either side so that ice 28 in cube or other form may be loaded into the center of the coil and water poured in after loading the ice.

For more efficient heat transfer, the coil 15 is made of a diameter somewhat smaller than the internal diameter of the container 11. In the present instance, the outer diameter of the coil 15 may be approximately 7 inches, while the inner diameter of the container may be approximately 8 inches. The main body of the coil is also proportioned so that its convolutions may be completely covered by the mixture of ice and water. In this case, the main body of the coil happens to be about 8 inches in height, while the container 11 is about 9 inches in height. The coil is positively held in place within the container 11 as by means of rigid spacers 29. The latter may be diametrically opposed and secured to the inner peripheral wall 14 by adhesive or any other suitable fastening means.

To use the appliance 10 for cooling, the supply of ice cubes or cracked ice 28 is loaded into the center of the device via the loading apertures 26. Water is then poured in over the ice to a level sufficient to cover the convolutions in the main body of the coil. The beverage to be cooled, such as the contents of a can of beer, is then poured slowly into the reservoir 22 and allowed to flow by gravity into the coil 15. A glass 31 or other receptacle is then placed or held under the tap 21. To be certain of filling the convolutions of the coil and eliminating air blockage, the discharge tap 21 is cracked open by turning the handle 30 an amount just sufficient to bleed off any trapped air. When a full cross sectional stream of fluid begins to exit from the tap, the latter is then closed and the small amount of fluid drained into the glass is poured back into the reservoir 22. After a short time interval, which may be on the order of two or three minutes, the beverage may be drawn from the appliance by opening the tap 21. Under normal operating conditions, the beverage will have a temperature of approximately 40 degrees F. which is very adequate for chilling. In the event, however, that further chilling should be desired, the beverage can be run through the appliance again in the manner described above.

In order to adapt the appliance 10 for heating, hot water is poured into the container 11 and around the coil 15 to a level sufficient to cover the main body convolutions. The fluid to be heated, such as clear soup or hot chocolate, is then poured into the reservoir 22 and entrapped air is bled off in the manner previously described. After a suitable time interval, the fluid may be drawn out of the tap 21 and will have the desired temperature. The extent of the heating will of course depend upon the temperature of the hot water poured into the container and the length of time that the fluid is permitted to remain in the coil. Both heating and cooling are accomplished without any dilution of the treated fluid.

Figure 3:
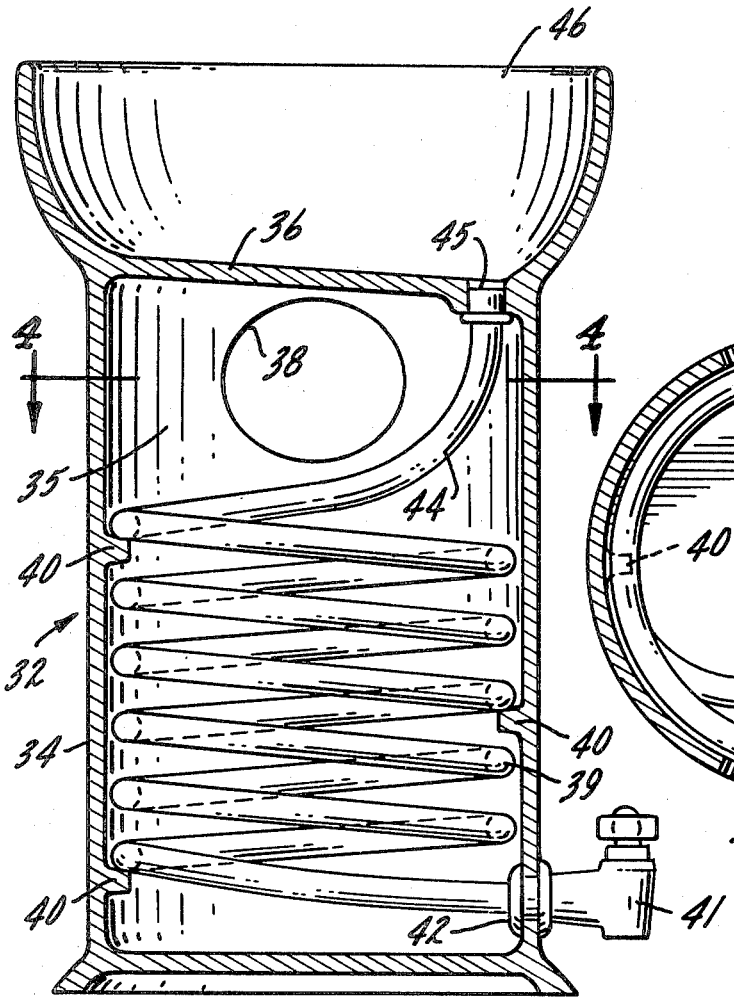
FIG. 3 is a vertical sectional view of an alternative form of the appliance illustrated in FIG. 1.
Figure 4:
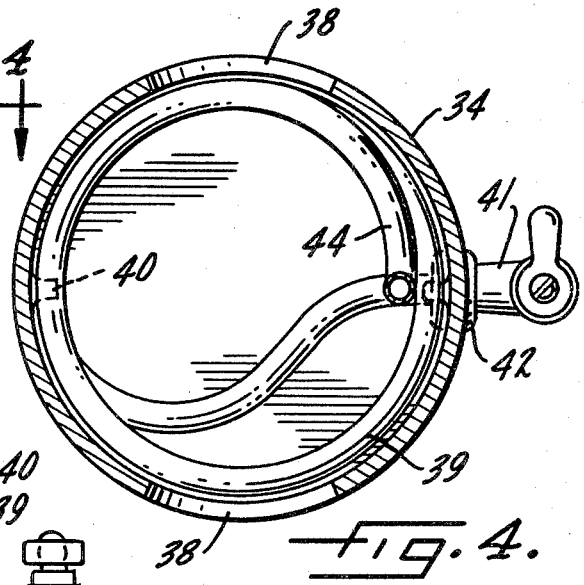
FIG. 4 is a horizontal sectional view through the appliance, taken in the plane of the line 4—4 in FIG. 3.

Turning now to FIGS. 3 and 4, an alternative form of appliance 32 is there shown which also exemplifies the present invention. The appliance 32 is generally similar to the appliance 10 but in this case has a container 34 with an upwardly extended sidewall 35 terminating in a closed panel 36. The extended sidewall 35 has a pair of loading apertures 38 for introducing ice and water into the appliance. The panel 36 defines the bottom of an intake reservoir 38 also integral with the container 34.

A heat exchange coil 39 similar to the coil 15 is mounted in the container 34 in spaced relation with the inner peripheral wall thereof. The coil is held in place by spacers 40 unitary with the inner wall of the container. The lower end portion of the coil terminates in a seal and tap 41, 42 similar to those of the coil 15. In this case, the upper end portion 44 of the coil 39 is extended radially inward of the container and then upward adjacent the wall thereof. The portion 44 terminates in an intake in the bottom panel of the reservoir 46. The panel 36 defining the bottom of the reservoir is pitched so that the intake 45 will be at the lowest point thereof. The appliance 32 may be operated in the same manner as the appliance 10.

By means of the foregoing construction, the loading apertures 38 in the upwardly extended container sidewall 35 are situated above the helical configuration of the heat exchange coil 39 and below the bottom panel 36 of the reservoir 38.

Figure 5:
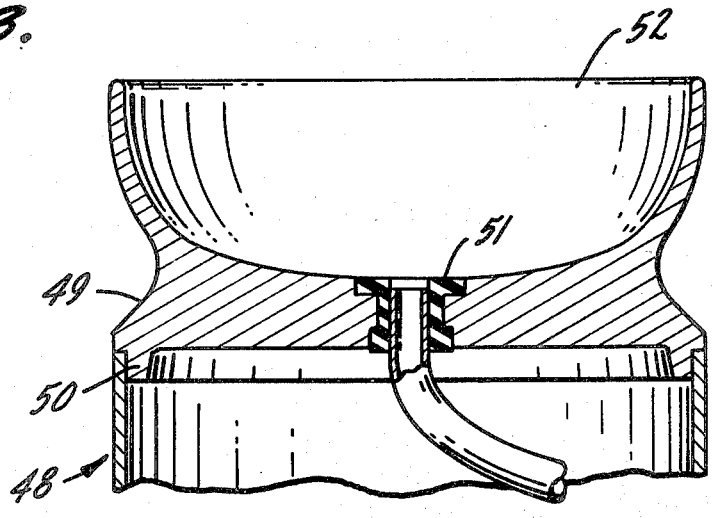
FIG. 5 is a vertical sectional view of still another alternative form of the appliance of FIG. 1.

FIG. 5 shows another alternate form of appliance 48 also exemplifying the invention. The appliance 48 is similar to the appliances 10 and 32 but differs in that it is provided with a removable top closure 49. The latter is formed with a skirt 50 and adapted to fit telescopically into the upper portion of the container, and to engage telescopically the upper end portion of the coil. A resilient telescoping seal 51 is interposed between the top closure 49 and the upper end portion of the coil. The seal provides a fluid-tight connection and also compensates for any slight misalignment of the intake relative to the top closure 49. Intake reservoir 52 is integral with the top closure and communicates directly with the intake of the coil.

In operation, the top closure 49 is removed from the container to permit loading with ice and water. The cover is then replaced on the container and the appliance is operated in the manner already described above.

Any of the appliances 10, 32 or 48 may readily be cleaned after usage by running boiling water through the reservoir and coil. The cleaning process may be expedited by connecting a rubber squeeze bulb to the intake.

I claim as my invention:

1. A portable quick chilling and heating appliance for fluids such as beverages comprising, in combination:

(a) a fluid tight container open at the top and adapted to rest upon a relatively flat support;

(b) a coil of metallic tubing wound in a generally helical configuration about an upstanding axis coinciding substantially with that of said container and having an upper end portion and a lower end portion;

(c) the convolutions of said helical configuration being of a diameter enabling them to be disposed in spaced relation with the inner peripheral wall of said container;

(d) a plurality of rigid spacers fixed to the inner peripheral wall of said container and disposed in positive abutting engagement with said coil to retain same in spaced relation with said inner peripheral wall;

(e) the upper end portion of said coil extending radially and axially of said coil so as to terminate at an intake situated above the top of said container;

(f) the lower end portion of said coil extending radially outward and passing through the wall of said container in fluid tight relation therewith;

(g) an outlet valve connected to said lower end portion of said coil;

(h) a reservoir connected in fluid tight relation to said intake;

(i) a support structure for said reservoir connected to said container and disposed in spaced relation above the helical configuration of said coil; and (j) said support structure comprising a bridge connected across the open end of said container and defining therewith at least one aperture for loading ice or a heating medium into said container, said loading aperture being situated between said reservoir and the helical configuration of said coil.

* * * * *